United States Patent [19]

Huffaker et al.

[11] Patent Number: 4,749,307

[45] Date of Patent: Jun. 7, 1988

[54] SEAL STRUCTURE FOR JOINT BETWEEN TWO STRUCTURAL SECTIONS

[75] Inventors: John R. Huffaker, Ellicott City; Dennis G. Robb, Pasadena; Brett E. Vasseur, Eldersburg, all of Md.

[73] Assignee: Baltimore Aircoil Company, Inc., Jessup, Md.

[21] Appl. No.: 9,764

[22] Filed: Jan. 14, 1987

[51] Int. Cl.[4] ..... E02B 9/04

[52] U.S. Cl. ..... 405/121; 405/119

[58] Field of Search ..... 405/118, 119, 121, 126, 405/135, 152; 285/370, 397

[56] References Cited

U.S. PATENT DOCUMENTS 3,213,627 10/1965 Blayden ..... 405/121
4,297,053 10/1981 Nicholas ..... 405/121

FOREIGN PATENT DOCUMENTS 36554 3/1980 Japan ..... 405/126
WO79/00848 11/1979 PCT Int'l Appl. ..... 405/121

*Primary Examiner*—David H. Corbin
*Attorney, Agent, or Firm*—Charles E. Bouton; Edward J. Brosius

[57] ABSTRACT

A flexible seal is used to cover and fill joints between water flume sections wherein the seal is in the form of a continuous web having a central deformable bead and the seal is secured to each section by both adhesive strips and a reinforcement compressing the seal and adhesive against each section.

10 Claims, 2 Drawing Sheets

SEAL STRUCTURE FOR JOINT BETWEEN TWO STRUCTURAL SECTIONS

BACKGROUND OF THE INVENTION

This invention relates to seals covering joints between two adjacent structural parts and more specifically to an improved seal structure for covering a gap left between two adjoining precast concrete sections to as to allow for relative movement between those concrete sections.

The particular need for the present invention arose in connection with the assembly of water flumes constructed of precast concrete sections where the concrete sections are positioned end to end with gaps of about one half to one inch left between adjacent sections so as to allow for expansion and contraction caused by changes in climatic temperature and/or temperature of the water carried within the flumes. The gaps are also advantageous to allow for slight shifting of the concrete sections due to foundation settlement and the like. To avoid unacceptable loss of water through the gaps some form of covering had to be devised which would withstand the force of water flow while remaining substantially water tight, yet also expand and contract as changes in the gap occurred between structural sections.

SUMMARY OF THE INVENTION

Accordingly it is a principal object of the present invention to provide an improved seal structure for covering a gap left between two structural members.

Another object of the present invention is to provide a water-tight seal structure for covering a gap left between two water conduit sections so as to provide for relative movement between those sections.

A further object of the present invention is to provide flexible seal structure for joining two adjacent structural members so as to accommodate for expansion and contraction while preventing the passage of fluid between those members.

Briefly summarized the invention involves the securing of a web of impervious material to adjacent portions of adjoining structural sections by both adhesive means and mechanical fastener means which compresses the web and adhesive means against the structural sections. Preferably the web includes a hollow deformable bead which is oriented between the structural sections.

DESCRIPTION OF THE DRAWINGS

Further objects and advantages of the present invention will become apparent from the following detailed description of a preferred embodiment when read in conjunction with the drawings wherein: .

DETAILED DESCRIPTION OF THE INVENTION

Figure 1:
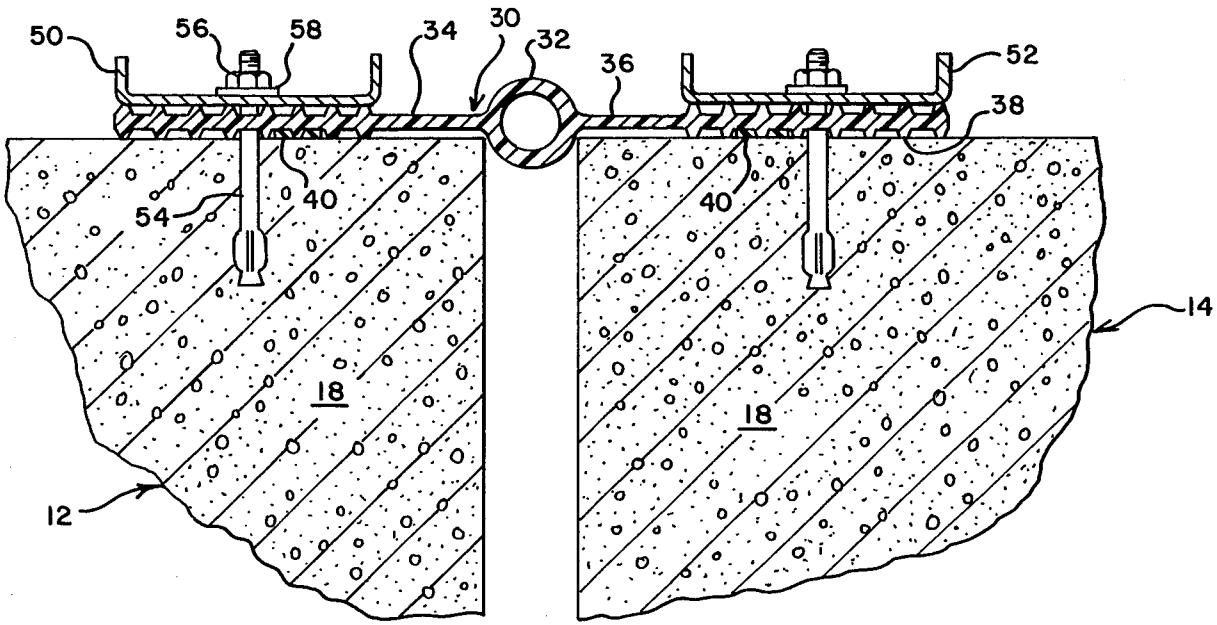
FIG. 1 is a detailed cross sectional view of a seal joining two concrete sections.

The preferred embodiment of the invention shown in the drawings pertains to a seal structure devised for precast water flume sections, but it is to be understood that the seal structure will have other applications to cover gaps left between adjacent structural sections made of other materials and for other purposes.

Figure 2:
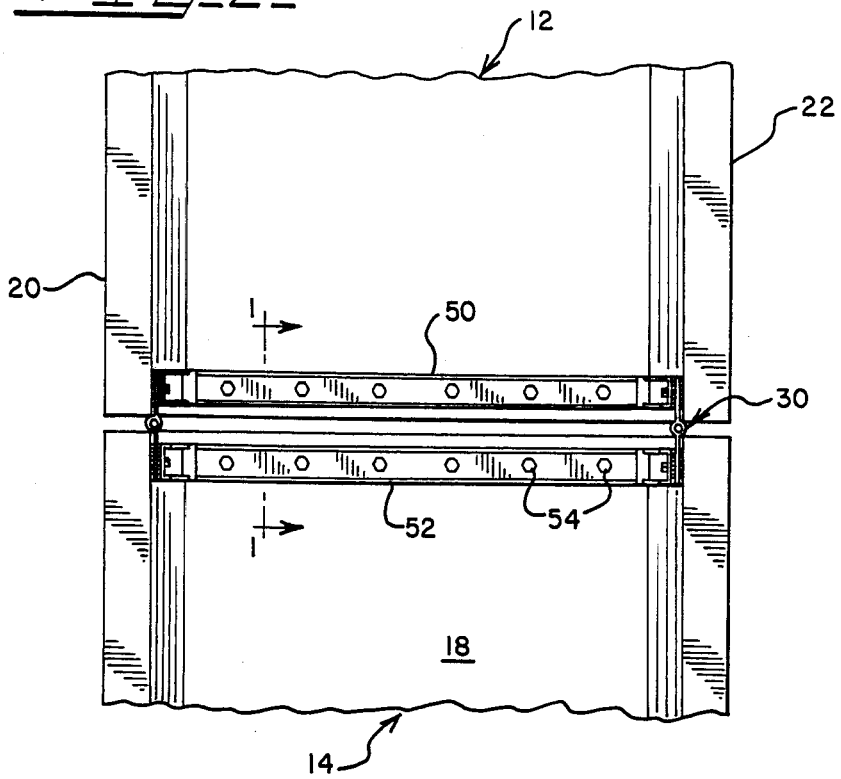
FIG. 2 is a partial plan view of two precast concrete flume sections joined by the seal structure shown in FIG. 1.
Figure 3:
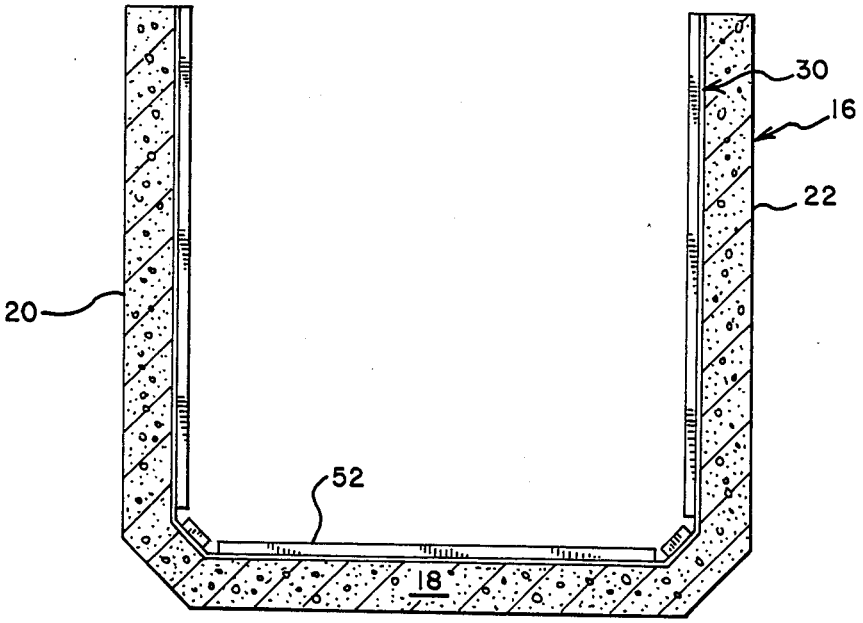
FIG. 3 is an end view of the structure shown in FIG. 2.

The illustrated embodiment of FIG. 1 includes two structural sections generally 12, 14 of concrete, or the like, such as the adjacent parts of a water flume generally 16, which include base 18 and side walls 20, 22 as shown in FIGS. 2 and 3. A web generally 30 of suitable material having appropriate characteristics of flexibility and elasticity is extended longitudinally along a gap left between the adjoining ends of structural sections 12, 14. Preferably the web is comprised of a strong elastomeric material such as a vinyl compound and, if desired, may be strengthened with fibers or the like. Other materials such as rubber and impregnated and coated fabric may be suitable web materials. It is advantageous to include a central longitudinal bead 32 in the web, which bead tends to rest in the gap and wedge between the ends of sections 12, 14 so as to resist the pressure of fluid above the seal structure. Preferably the bead 32 is deformable, as by being hollow, so as to change in cross section as it may be compressed or released by relative movement between the two structural sections 12, 14.

To each side of the central bead 32 the web extends as flaps 34, 36 across portions of the respective structural sections 12, 14. The side flaps 34, 36 may advantageously include longitudinal ribs 38 generally parallel to the bead 32, which ribs may be formed in either or both upper and lower surfaces of the web 30. It is essential to this invention that an adhesive means bonds each side flap 34, 36 to the respective structural section 12, 14. In the preferred form the adhesive means comprise narrow strips 40 of soft tacky butyl rubber. Preferably where ribs 38 are formed on the underside of the side flaps 34, 36 the adhesive strips 40 are positioned to straddle at least one such rib.

Additionally it is essential to the present invention that a means for reinforcing the upper surface of each side flap 34, 36 be applied so as to at least partially overlie the adhesive strips 40 and that the web 30 and strips 40 be compressed against the structural sections 12, 14. This is accomplished by relatively stiff reinforcing members 50, 52, which preferably are in the form of light metal channels, that extend parallel to the gap between the structural sections 12, 14. The inner edges of the reinforcing members 50, 52 (the edges closer to the bead 32) are located slightly inward of the adhesive strips 40, 42; and the outer edges are essentially coextensive with the outer edges of the web side flaps 34, 36, respectively.

The reinforcing members 50, 52 are held in place and compressed against the side flaps 34, 36 by means of plural bolts, or the like, such as threaded expansion anchors 54, which are secured in holes drilled in the precast concrete of structural sections, 12, 14, and extend upwardly through holes in the web side flaps 34, 36 and holes in the respective reinforcing members 50, 52. Nuts 56 are mounted on the bolt threads and are screwed down upon washers 58 with sufficient torque to compress the reinforcing members 50, 52 against the web 30 whereby to mechanically hold the side flaps 34, 36 firmly against the structural sections and to enhance the adhesive bonding between the strips 40 and the opposed surfaces of both the web 30 and the structural members. The presence of ribs will enhance the integrity of both the mechanical seal and the adhesive seal between the web 30 and both structural sections 12, 14.

EXAMPLE

In one installation involving precast concrete water flume sections approximately seven feet tall and seven feet ten inches wide (internal measure) having an open top and two beveled corners at the closed bottom (as shown in the drawings) the joints between sections are covered with a continuous web of polyvinyl chloride material approximately twenty one feet long. The web is nine inches wide and nominally 3/16 inch thick at the center narrowing to ⅛ inch at the edges and with a central longitudinal hollow bead having a wall thickness of about 3/32 inch. The bead is formed oval with outer dimensions of ½ inch and 11/16 inch (normal to the web). Inward of each edge of the web there are a series of eight longitudinal ribs on both top and bottom surfaces, each rib being in the form of truncated teeth approximately 3/32 inch high and of 0.140 inch width (at the base) narrowing to 0.045 inch (at the free end). Butyl rubber strips ⅛ inch thick and one inch wide are laid between the flume surfaces and the ribbed portions of the web. Stainless steel channels 3¼ inch wide with ¾ inch are formed from ⅛ inch thick stock cut to lengths approximately equal to the flat bottom side and bevel surfaces of the flume; and are secured to the precast concrete and compressed against both edges of the web by ¼ inch diameter anchor bolt on spacings of 13–15 inches (6 inches on the bevels).

The foregoing detailed description has been given for clearness of understanding and to provide a complete description of a preferred embodiment of the invention. Various modifications may be made without departing from the spirit and scope of the invention which is defined in the following claims.

What is claimed is:

1. An improved seal structure for covering a gap between two adjacent structural sections while allowing for relative movement between sections, said seal structure comprising:

a web of flexible material positioned longitudinally across said gap so as to overlie portions of said two adjacent sections;

separate adhesive means extending parallel to said gap on each of said portions of said structural sections, each said adhesive means being located beneath said web;

separate reinforcing means at each said structural section, said reinforcing means extending substantially parallel to said gap overlying said web and each of said adhesive means; and compression means fastening said reinforcing means to each of said structural sections whereby to compress said web and adhesive means between each said structural section and reinforcing means.

2. The structure of claim 1 wherein said web includes a central longitudinal bead that is positioned to overlie said gap.

3. The structure of claim 2 wherein said web is an elastomer material and said bead is hollow and capable of deformation with changes in said gap caused by expansion or contraction of said structural sections.

4. The structure of claim 1 wherein said web includes longitudinal ribs between said reinforcing means and said structural sections.

5. The structure of claim 4 wherein said adhesive means is a strip of butyl tape.

6. The structure of claim 1 wherein said adhesive means is a strip of butyl tape.

7. The structure of claim 1 wherein said reinforcing means is a relatively inflexible channel shaped member.

8. The structure of claim 7 wherein said compression means comprises a plurality of bolts secured in said structural sections and extending through said web and said channel shaped members, each of said bolts having nuts threaded thereon to compress said channel shaped members toward said structural section.

9. An improved seal structure for covering a gap between two adjacent structural sections of precast concrete in a water flume while allowing for relative movement between sections, said seal structure comprising:

a web of elastomer material positioned longitudinally across said gap, said web having side flaps which overlie portions of each of said adjacent structural sections;

separate reinforcing channel members substantially coextensive with said side flaps, said channel members being spaced from said gap and located above each of said side flaps;

separate strips of adhesive material extending between each of said side flaps and a respective structural section parallel to said gap and beneath a reinforcing channel member; and a plurality of anchor bolts secured in the concrete of each of said structural members and extending through said side flaps and reinforcing channel members with nuts threaded on said anchor bolts to compress said reinforcing channel members, side flaps and adhesive material against said structural sections.

10. The structure of claim 9 wherein said web includes a central longitudinal hollow bead that is positioned to overlie and wedge into said gap and is capable of deformation with changes in said gap caused by expansion or contraction of said concrete structural sections.

* * * * *